United States Patent [19]

Williams

[11] 4,366,385

[45] Dec. 28, 1982

[54] ENGINE STARTER DRIVE

[75] Inventor: James O. Williams, Horseheads, N.Y.

[73] Assignee: Facet Enterprises, Inc., Tulsa, Okla.

[21] Appl. No.: 199,410

[22] Filed: Oct. 22, 1980

[51] Int. Cl.[3] ..... F02N 11/00

[52] U.S. Cl. ..... 290/38 R; 290/48; 290/DIG. 1; 123/179 M

[58] Field of Search ..... 290/38, 48; 123/179

[56] References Cited

U.S. PATENT DOCUMENTS

| | | | |
|---|---|---|---|
| 2,727,158 | 12/1955 | Seilly | 290/38 R |
| 3,084,561 | 4/1963 | Mattson | 290/38 R |
| 3,177,368 | 4/1965 | Seilly | 290/48 X |
| 3,465,353 | 9/1969 | Buxton et al. | 123/179 M |
| 3,572,133 | 3/1971 | Giometti | 290/38 X |
| 3,791,685 | 2/1974 | Hamman | 290/48 X |
| 3,922,558 | 11/1975 | Hollyoak | 290/38 A |
| 4,156,817 | 5/1979 | Preece et al. | 290/38 R |

*Primary Examiner*—J. V. Truhe

*Assistant Examiner*—W. E. Duncanson, Jr.

*Attorney, Agent, or Firm*—Remy J. VanOphem

[57] ABSTRACT

A starter drive for internal combustion engines is disclosed. The starter drive is mounted within the starter housing and connected to the motor driven shaft. The shaft has a screw thread formed thereon near the armature of the starter and a cylindrical end portion. A screw sleeve member cooperatively engages the threaded screw of the motor driven shaft. A ring armature member is centrally mounted to the threaded screw member. A unidirectional clutch member connects the screw sleeve member, the ring armature member and the drive pinion gear. An engaging member holds the ring armature member to the starter housing when the drive pinion is advanced axially along the motor driven shaft by the rotation of the motor when the motor is activated. Thus, the drive pinion engages the engine ring gear such that the drive pinion is held in mesh with the engine ring gear and the total motor torque is transmitted to the engine ring gear until the motor is deactivated.

20 Claims, 9 Drawing Figures

Fig-1
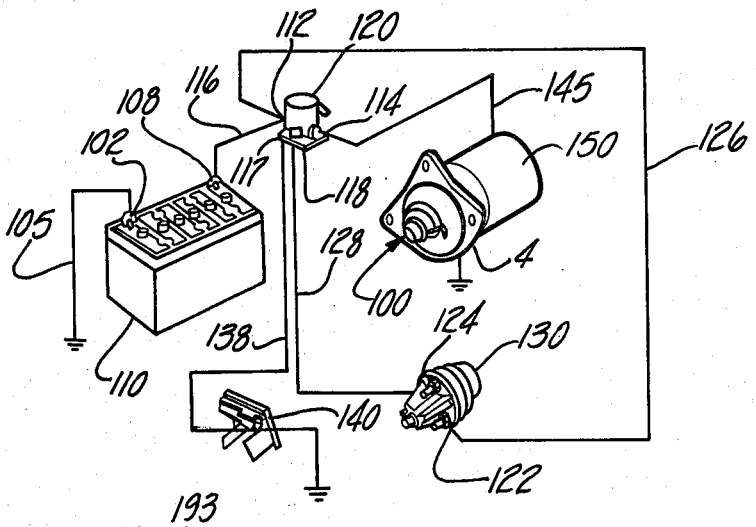
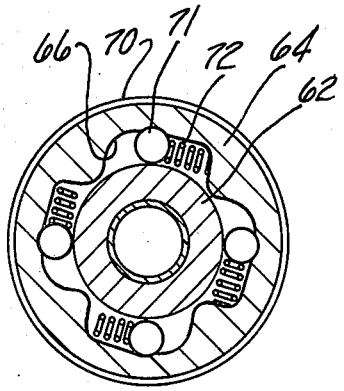
Fig-7
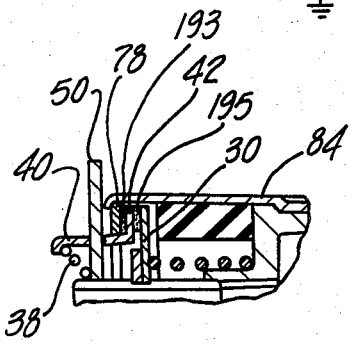
Fig-6
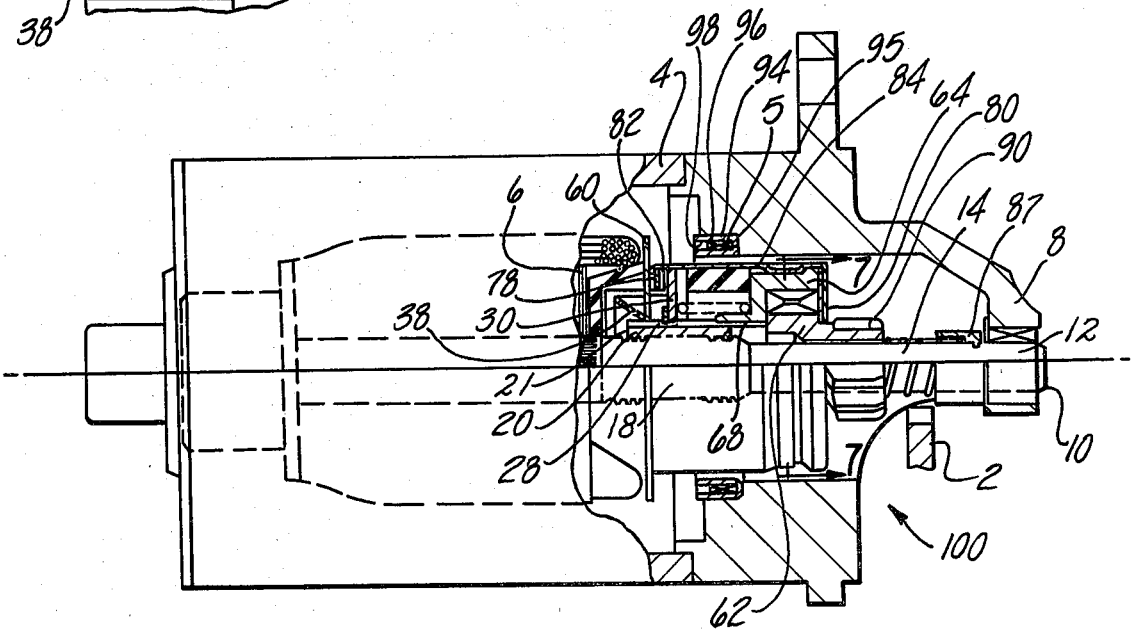
Fig-2

ENGINE STARTER DRIVE

FIELD OF THE INVENTION

The present invention relates to engine starters for internal combustion engines and more particularly to starters of the positive shift type wherein after the starter motor pinion engages the flywheel ring gear of the engine to be started, the coaxial solenoid prevents the pinion gear from demeshing until the starting motor is deenergized.

BACKGROUND OF THE INVENTION

Heretofore, starting motors of the so called piggyback solenoid type, that is, those having a shifting solenoid mounted on the outside of the starter motor housing, have been used extensively in automotive and allied industries for starting internal combustion engines. However, in present industrial and automotive applications, the piggyback solenoid engine starter is not completely satisfactory because of the space that the piggyback solenoid occupies. Also, it is desirable from a production standpoint, to produce a starter housing that is easily adaptable to the various mounting positions required to satisfy a number of engine configurations. By eliminating the piggyback solenoid from the outside of the starter motor housing, the starter motor housing may be mounted in any desirable orientation on the engine without special consideration being given to the shifting solenoid or related parts. In addition, the starter motor can be manufactured to satisfy the various mounting requirements for various types of internal combustion engines, thereby limiting the need of manufacturing several types of starter motor housings.

DESCRIPTION OF THE PRIOR ART

Coaxial solenoid type starter motors which eliminate the need for piggyback solenoids are not new, and have been known in the prior art. For example, Mattson, U.S. Pat. No. 3,084,561 uses a movable solenoid and helical splines to move the pinion and overrunning clutch prior to closing the motor power switch to rotate the armature. Giometti, U.S. Pat. No. 3,572,133 has a friction connection between the shiftable drive portion and the starter drive housing for assisting the advance of the shiftable drive portion into engagement with the ring gear. An electromagnetic brake is also provided in order to prevent drive rotation and to facilitate drive advance into engagement with the ring gear. As the pinion drive engages the ring gear, the brake is deenergized. Seilly, in U.S. Pat. No. 2,727,158 uses a solenoid to move the shiftable drive portion axially to initially engage the engine ring gear. As this occurs, a switch closes the contact to pass current through the motor to rotate the starter shaft. This causes the shiftable drive portion to further slide axially into full engagement with the ring gear. A catch ball arrangement is provided to secure the shiftable drive portion to the sleeve which then deenergizes the solenoid. In U.S. Pat. No. 3,124,694, Seilly provides an axially movable core to impart initial axial movement to the shiftable drive portion. Hollyoak, in U.S. Pat. No. 3,922,558 provides an electromagnetic arrangement for moving the pinion assembly from its rest position to its operative position. In the drive connection, between the electromagnetic arrangement and the pinion assembly, there is a member which bears against one end of the pinion assembly. This member, in the rest position of the pinion assembly, is trapped between the pinion assembly and a collar carried by the shaft. When the electromagnet is energized, it moves the armature in such a manner that the pinion assembly is urged by way of the member towards its operative position. The shaft and the pinion assembly rotate relative to the armature and the member when the electric motor is energized. However, the armature and the member act as a brake to inhibit rotation of the pinion assembly and the shaft, when the pinion assembly returns to its rest position. In the rest position, the member is trapped between the pinion assembly and the collar carried by the shaft. Finally, Nardone, in U.S. Pat. No. 1,939,405 and Celio in U.S. Pat. No. 2,333,765 use an electromagnet to cause axial movement of the drive portion into mesh with the flywheel prior to causing the rotation of the starter motor shaft.

None of the above identified prior art starter motors have proven entirely satisfactorily for present day use for various reasons. Either they were unreliable in service over an extended period of time or they were too expensive to manufacture. Many other problems were also presented in the production of coaxial types of starters such as the provision of suitable electrical characteristics of the solenoid and accompanying parts, the provision of a suitable on/off switching for the electric starting motor and the reduction of overall manufacturing costs, all of which heretofore have not been completely satisfactorily solved. In addition, all of the above identified prior art designs utilize an electromagnetic coil with relatively large current draw to facilitate drive advance to engage with the ring gear.

SUMMARY OF THE INVENTION

The present invention is directed to a starter drive which advances the drive pinion on helical splines without rotation, by inertia, to engage the engine ring gear. The drive pinion is held in engagement with the engine ring gear by an engaging mechanism which allows total motor torque to be transmitted to the ring gear until the motor is deactivated.

The present invention provides a starter drive for internal combustion engines having a starter drive housing, a motor driven shaft having a cylindrical end portion and a helical threaded portion between the cylindrical end portion and the motor. The starter drive includes a screw sleeve mechanism for cooperatively engaging the helical threaded portion on the motor driven shaft. A ring armature member is centrally disposed relative to the screw sleeve mechanism and connected to the screw sleeve mechanism. Furthermore, a drive pinion is coaxially disposed on the cylindrical end portion of the motor driven shaft. In addition, a unidirectional clutch mechanism interconnects the screw sleeve mechanism and the drive pinion. Finally, the ring armature mechanism is engaged to the starter drive housing when the drive pinion is advanced along the motor driven shaft by the rotation of the motor when the motor is activated so as to engage the engine ring gear. Thus, the drive pinion is held in engagement with the engine ring gear and the total motor torque is transmitted to the ring gear until the motor is deactivated.

It is, therefore, a primary object of this invention to provide an engaging mechanism which secures the ring armature mechanism to the starter drive housing when the drive pinion is advanced along the motor driven shaft by the rotation of the motor when the motor is activated so as to engage the engine ring gear such that the drive pinion is held in full engagement with the engine ring gear by the engaging mechanism.

It is another object of the present invention to provide an engaging mechanism to hold the ring armature mechanism to the starter drive housing when the drive pinion is advanced along the motor driven shaft by the rotation of the motor when the motor is activated so as to engage the engine ring gear such that the total motor torque is transmitted to the engine ring gear until the motor is deactivated.

It is yet still another object of the present invention to provide an engaging mechanism which holds the ring armature mechanism to the starter drive housing after the drive pinion has advanced along the motor driven shaft by the rotation of the motor when the motor is activated so as to engage the engine ring gear such that the drive pinion is held in engagement with the engine ring gear until the engaging mechanism is deactivated. In addition, a unidirectional clutch mechanism interconnects the screw sleeve mechanism and the drive pinion so as to permit overrunning in one direction of rotation of the motor shaft.

Other objects and advantages of the invention will become apparent upon reading the following detailed description on reference to the drawings.

BRIEF DESCRIPTION OF THE DRAWINGS

FIG. 1 is a schematic view of an electrical starting circuit for a starter according to my invention;

FIG. 2 is a side view of the preferred embodiment of the starter drive according to my invention, partially in section, in the energized position;

FIG. 6 is a side view of an alternate embodiment of a starter drive according to my invention, partially in section, in the energized position;

FIG. 7 is a sectional view along 7—7 in FIG. 2.

DETAILED DESCRIPTION OF THE PREFERRED EMBODIMENTS

Figure 3:
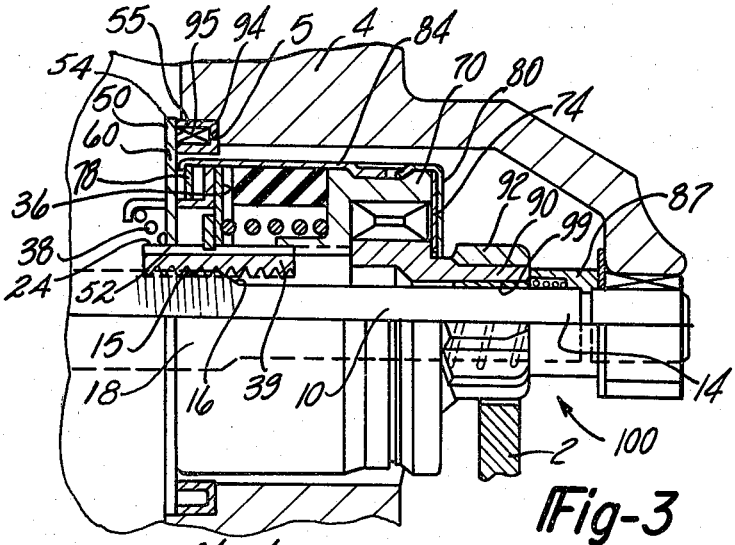
FIG. 3 is a side view of the preferred embodiment of the starter drive according to my invention, partially in section, with the pinion gear fully engaged to the ring gear.

Referring to FIG. 1, the invention is shown in connection with the starting circuit for a conventional automobile engine. A battery 110 is connected at the first terminal post 102 by a cable 105 to ground. A relay 120 is connected at one end 112 by a cable 116 to the second terminal post 108 of the battery. A starter switch 130 is connected at one terminal post 122 by a cable 125 to the one end 112 of the relay. The other terminal post 124 of the starter switch is connected to a third end 118 on the relay 120 by means of a cable 128. A transmission neutral switch 140 is connected at one end to the ground and at the other end to a fourth end 117 in the starter relay by means of a cable 138. The second end of the relay 114 is connected by means of a cable 145 to the starter motor 150. The starter motor 150 incorporates a starter drive generally designated as 100 according to my invention as will be more fully described herein. Finally, the starting ciruit is completed by connecting the starter motor housing 4 to ground.

As is shown in FIGS. 2–5 the starter drive 100 is mounted on a drive shaft 10 which is rotatably mounted in the motor starter housing 4 and which extends from the electric motor armature 6 to the motor housing nose 8. The drive shaft 10 further has a dimetral or first cylindrical portion 14 adjacent the one end 12. The drive shaft 10 also has axial advancing means 15 including for example, helical splines formed on a second cylindrical portion 18 which extends between the first cylindrical portion 14 and the electric motor armature 6 as is shown in FIGS. 2–5.

The starter drive 100 includes screw sleeve means 39, ring armature means 60, a drive pinion or pinion gear 90, the unidirectional clutch means 80, and engaging means 94. The starter drive 100 engages a ring gear 2 of the internal engine (not shown) to be started.

The screw sleeve means 39 includes an axially extending sleeve member 20 and a first annular ring member 30. The axially extending sleeve member 20 has a one end 21 and another end 29. The axially extending sleeve member 20 is connected to the drive shaft 10 by a mutually engageable helical spline connection 26 on its inner diameter. Thus, the axially extending sleeve member 20 is slidably and rotatably advanced along the drive shaft 10 by virtue of the mutually engaging helical splines 16, 26 when the drive shaft rotates. The axially extending sleeve member 20 also has an outer diameter 24 which has straight splines 28 formed thereon which extend from one end 21 to the other end 29. A circular notch or annular groove 22 is also formed on the outer diameter 24 between the one end 21 and the other end 29. A first annular member 30 is mounted on the straight splines 28 and located adjacent the groove 22 formed on the axially extending sleeve member 20. The first annular ring member 30 also has an outer diameter 34. A first retaining ring 32 is inserted into the annular groove 22 to fix the location of the first annular member 30 on the axially extending sleeve member 20.

Figure 8:
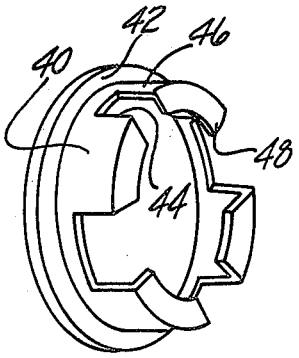
FIG. 8 is a perspective view of the washer member.
Figure 4:
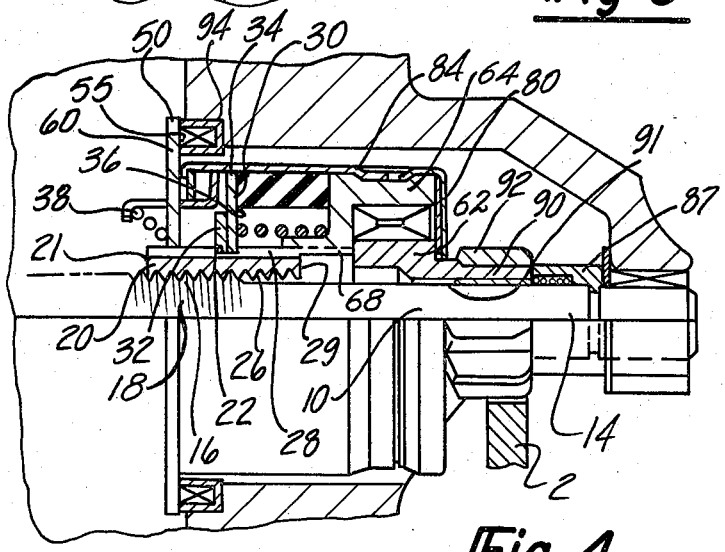
FIG. 4 is a side view of FIG. 2 partially in section, in the cranking position.

The ring armature means 60 includes a washer member 40 and a second annular member or ring armature 50. The washer member 40 has a one end portion 42 which extends radially. The one end portion 42 is mounted proximate to the outer diameter 34 of the first annular member 30. The washer member extends longitudinally along a longitudinal portion 46 to the opposite end portion 48. The opposite end portion 48 also extends radially. The longitudinal portion 46 has a plurality of slots 44 beginning longitudinally a distance from the one end 42 and extending in the direction of the opposite end portion 48 the washer as clearly shown in FIG. 8, for a purpose described herein later.

Figure 9:
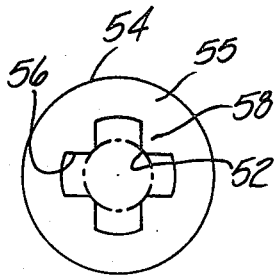
FIG. 9 is a front view of the ring armature member.

The second annular member or ring armature 50 has an outer diameter 54, an inner diameter 52, a radial surface 55 with a plurality of arcuate slots 56 partially extending from the inner diameter towards the outer diameter as shown in FIG. 9. The ring armature 50 is mounted in the washer member 40 by inserting the longitudinal portions 46 of the washer 40 into the arcuate slots 56 in the ring armature 50. A first biasing member 38 is positioned between the opposite end portion 48 of the washer member 40 and the ring armature 50. The first biasing member 38, for example, a helical conical spring member thus biases the ring armature 50 toward the one end portion 42 of the washer member 40.

The pinion drive member or pinion gear 90 has an inner diameter 91 into which a bearing 99 is fastened thereto as shown in FIGS. 2–5. Thus, the pinion drive member 90 is slidably mounted on the first cylindrical portion 14 of the drive shaft 10 with a bearing therebetween. The pinion drive member 90 has a plurality of teeth 92 formed thereon which are adapted for movement into and out of engagement with the engine ring gear 2 of the internal combustion engine (not shown) to be started.

The unidirectional clutch means 80 includes a unidirectional roll clutch 70, a case member 84, a second retaining ring member or abutment member 78, a resilient member 88 and a second biasing member 76. The pinion drive 90 is connected to the inner race 62 of the unidirectional roll clutch 70. The inner race 62 is mounted to the outer race 64 of the unidirectional roll clutch 70. The outer race 64 is coupled by splines 68 which cooperatively engage the straight splines 28 of the axially extending sleeve member 20 near the other end 29. The outer race 64 has a plurality of cam surfaces 66 formed therein as shown in FIG. 7. A roller spring 72 and a roller 71 are inserted into each of the cavities formed by the cam surfaces 66 between the inner and outer races. Each roller 71 and its respective spring 72 are retained in their respective cavities by a pair of half washers 74 as shown in FIGS. 2–5. The rollers, springs and half washers are contained between the inner and outer races by a cup-shaped case member 84. The cup-shaped case member 84 is mounted onto the outer diameter of the outer race 64 and extends radially inward at one end toward the inner race 62. The cup-shaped case member 84 extends from the outer race 64 longitudinally along the axis of the drive shaft 10 toward the electric motor armature 6 and terminates between the second retaining ring 78 and the radial face 55 of the armature 50. A groove 82 is formed in the case member for a purpose to be described herein later. When the drive shaft rotates and torque is transmitted from the drive shaft through the helical splines and straight spline to the outer race 64, the rollers 71 are wedged against the cam surface 66 by the roller springs 72 to prevent relative movement of the outer race 64 to the inner race 62 to transmit torque to the pinion drive 90. When the engine begins to overrun the speed of the drive shaft, the engine ring gear 2 drives the pinion drive 90 faster than the drive shaft 10 is rotating. As this occurs, the inner race 62 urges the rollers 71 against the roller springs 72 and away from the cam surfaces 66. Thus, the pinion drive 90 and inner race 62 can overrun relative to the other members of the starter drive 100.

The cup-shaped case member 84 confines the first annular ring member 30 as well as the one end portion 42 of the washer member 40 in the cavity, defined by the cup-shaped member, by means of a second retaining ring or abutment member 78 inserted in the groove 82. First annular member 30 and the one end portion 42 of the washer member 40 are thus free to move axially within the cup-shaped case member 84 toward the drive pinion member 90 but are prevented from moving axially towards the electric motor armature 6 beyond the groove 82 by the abutment member 78 as well as the retaining ring 32.

Figure 5:
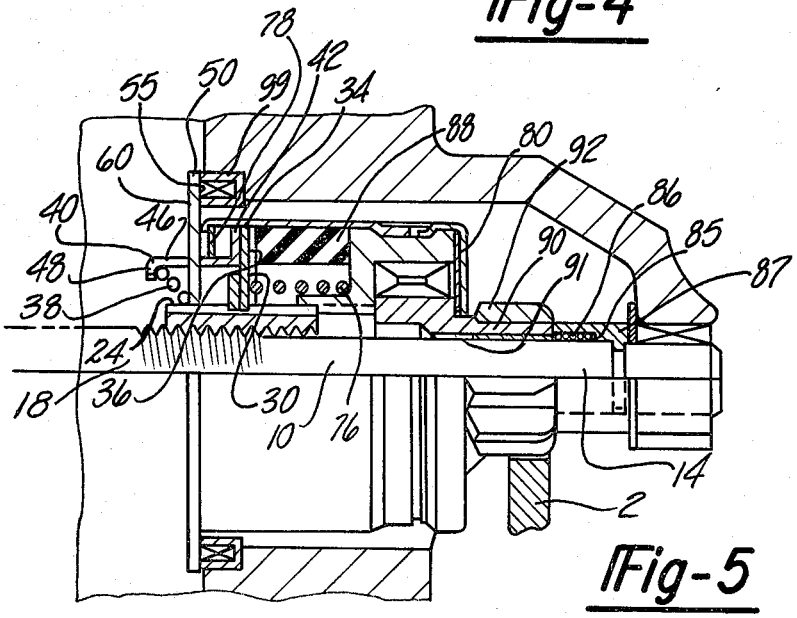
FIG. 5 is a side view of FIG. 2, partially in section, in the overrun condition.

A resilient member 88 in the preferred embodiment is a compressible annulus of resilient material such as rubber, however, other materials and configurations are possible in practicing my invention. Resilient member 88 is pendently mounted to the outer race 64 and the first annular ring member 30 so as to be within the cup-shaped case member 84. A second biasing member 76 is preferably a helical spring member which is arranged in the cup-shaped case member 84 so as to extend between the outer race 64 and the first annular ring member 30. Thus, the second biasing member 76 biases the outer race 64 away from first annular ring member 30, along the mating splines 28, 68 in a direction of maximum extension relative to the axially extending sleeve member 20. The second biasing member 76 thereby provides a gap between the abutment member 78 and the first annular ring member 30 on the axially extending sleeve member 20 as shown in FIGS. 2, 3 and 5. In other words, the spring force of 76 is higher than spring force of 38 to provide a gap.

The engaging means 94 includes a fixed or stationary magnet body 95 adapted to be secured in a cavity 5 in the starter motor housing 4. The magnet body 95 is fabricated of magnetic flux conducting material such as iron or steel. The magnet body 95 is formed to provide an annular recess or cavity 98 within which is mounted an electromagnetic coil 96 which may be secured in the cavity by the use of a resin or other well known conventional means. The electromagnetic coil 96 has a set of leads (not shown) which may be connected through an appropriate electrical connector as is well known in the art (not shown). The magnet body 95 is mounted within the starter motor housing 4 such that when the pinion gear 90, unidirectional clutch means 80, ring armature means 60, and screw sleeve means 39 are translated axially along the helical splines, due to inertia, to engage the engine ring gear 2 by the rotation of the drive shaft 10, the radial surface 55 of the second ring armature member 50 which extends radially above the cup-shaped case member 84 is engaged by the magnet body 95 when the electromagnetic coil 96 is energized.

When electrical power is supplied through leads to the electromagnetic coil 96, a magnetic field is generated. This magnetic field is insufficient to pull the starter drive 100 axially along the drive shaft. The electromagnetic coil, by way of nonlimiting example only draws about a one half amperes of current. This is in contrast to prior art designs with piggyback solenoids which require an order of higher magnitude amperage in order to engage a conventional starter drive with an engine ring gear. When the radial surface 55 of the ring armature 50 contacts the magnet body 95, the flux path generated by the magnetic field travels in a loop through the magnet body 95 through the ring armature member 50 and returns back to the magnet body member 95. The magnetic flux thus keeps the ring armature member 50 in engagement with the magnet body 95 and thus provides a closed contact between the pole faces of the magnet body and the ring armature. In doing so, the magnet body 95 clamps the radial surface 55 thereby preventing the ring armature member from rotating with the screw sleeve means 39. A stop member 87 is provided adjacent the one end of the drive shaft and is positioned on the first cylindrical portion 14 of the drive shaft to limit the axial travel of the pinion member along the drive shaft toward the motor housing nose 8. The stop member 87 further has a counterbore 85 formed therein to permit placing an antidrift biasing member 86 around the drive shaft and into the counterbore 85. The biasing member 86 extends from the pinion gear to the stop member 87. As the pinion gear moves axially to engage the ring gear, the antidrift biasing member compresses and fits within the counterbore 85 in the stop member 87. When the motor is deenergized, the antidrift biasing means 86 prevents the pinion gear 90 from moving along the drive shaft and contacting the engine ring gear.

OPERATION

When it is desired to start the internal combustion engine, the starter switch 130 is activated to provide electrical connection through the relay means 120 to the electrical motor armature 6 and the electromagnetic coil 96. In some cases, a transmission neutral switch means 140 is connected to the relay means preventing an electrical connection through the relay means when the transmission neutral switch means is activated until the transmission neutral switch is in a neutral and/or park position. When the electrical motor armature 6 is energized, the drive shaft and armature begin to rotate. Because of inertia, the screw sleeve means 39, ring armature means 60, unidirectional clutch means 80 and the pinion drive member 90 do not rotate relative to the drive shaft. Thus, the screw sleeve means 39 is advanced axially by the screw jack action of helical splines 16, 26 until the pinion drive member 90 engages the engine ring gear 2.

In the case of abutment of one of the pinion teeth 92 with the engine ring gear 2, the axially extending sleeve member 20 compresses the second biasing member until the first annular ring member 30 abuts against the resilient member 88. Since further axial movement of the axially extending sleeve member 20 toward the engine ring gear 2 is prevented by the abutment, the axially extending sleeve member 20 begins to rotate on the drive shaft by the action of the helical splines 16, 26. This rotation of the axially extending sleeve member is transmitted to the unidirectional clutch means 80 and the pinion gear 90 through the mating straight splined connection 28, 68 on the axially extending sleeve member 20. As the pinion rotates, the abutting tooth clears the obstructing tooth on the ring gear. As the obstructing tooth on the ring gear is cleared, the second biasing member 76 urges the pinion gear and the unidirectional clutch means axially along the straight splines 28, 68 until the teeth 92 on the pinion gear 90 fully engage the engine ring gear 2.

As the pinion gear engages the ring gear, the radial surface surface 55 of the ring armature member is contacted by the magnet body 95. The electrical power supplied through leads to the electromagnetic coil 96 generates a magnetic field whose flux path travels in a loop through the magnet body 95, through the ring armature member 50 and returns back to the magnet body member 95. The magnetic flux thus exerts an axial pull which provides closed contact between the pole faces, magnet body and the ring armature member which prevents the ring armature member from rotating with the screw sleeve means or to move axially relative to the magnet body while the electromagnetic coil 96 is energized. Simultaneously, the pinion gear is prevented from rotating by the resisting torque of the internal combustion engine. Since the motor drive shaft continues to rotate, the amount of torque being transmitted through the starter drive will begin to rise up to a high peak value. The axially extending sleeve member, on the other hand, begins to axially advance along the helical splines 16, 26 until the surface 36 of the first annular ring member 30 abuts against the resilient member 88. The resilient member is compressed by the axially advancing first annular ring member on the axially extending sleeve member until the resistance to compression of the resilient member is greater than the force required to overcome the resistance of the engine to rotation. Thus, the engine begins to crank. The resilient member also acts to absorb some of the high peak torque which was previously described. Thus, the metal fatigue normally encountered when metal parts are subjected to high peak torque values is substantially reduced. Once the internal combustion engine begins to crank, the starter drive permits the total developed electric motor torque to be transmitted to the engine ring gear because of the direct mechanical interconnection between the drive shaft 10 and the starter drive 100 of my invention.

Upon ignition of the internal combustion engine, the engine ring gear 2 rotates the pinion gear 90 faster than the rotation of the starter drive. Thus, the pinion gear overruns the starter drive and the screw sleeve means 39 attempts to move axially along the drive shaft on the mutually engaging helical splines 16, 26 towards the electric motor armature means 6 and attempts to demesh from the engine ring gear. As this occurs, the first annular ring member 30 which is rotating and moving toward the electric motor armature means 6 applies a frictional force against the one end portion of the washer member 40 which is stationary. This frictional force creates a torque equal and opposite to that developed by the overrunning clutch. Thus, a state of equilibrium is created to keep the pinion gear 90 in mesh with the engine ring gear 2. This frictional force also helps control the motor drive shaft free spin during the overrun condition. This arrangement eliminates the need to provide a shunt coil to limit the free spin of the motor drive shaft as required by many prior art designs. When the starting motor is deenergized, as for example by deactivating the switch means 130, the electromagnetic coil 96 is also deenergized. Thus, the magnetic body 95 releases its hold on the ring armature member 50 and allows the starter drive to demesh by inertia and the force of antidrift spring. The antidrift biasing member 86 serves as an antidrift spring to prevent the inadvertent engagement of the pinion gear with the engine ring gear when the motor is deactivated.

In an alternate embodiment of the invention, as is shown in FIG. 6, where like numerals designate like components, a first annular fiber friction member 193 is interposed the abutment member 78 and the one end portion 42 of the washer member 40 with the cup-shaped case member 84. Similarly, an annular friction member 195 is inserted between the ring member 30 and the one end portion 42 of the washer member 40. The first and second annular fiber friction members 193, 195 are mounted to the inner diameter of the cup-shaped case member 84 as by conventional adhesive means. The first and second annular friction members 193, 195 help increase the frictional torque level available to oppose the torque developed by the overrunning clutch gearing pinion overrun. This also helps reduce the size of the electromagnetic coil required to hold the armature ring member during such periods of overrun as well as it helps to absorb some of the peak torque developed during an engine misfire and clutch overrun conditions. The operation of this alternate embodiment is similar to that of the preferred embodiment except that the first and second annular friction members help to increase the torque level available to resist the torque developed by the overrunning clutch attempting to demesh from the engine ring gear.

While the invention has been described in connection with the preferred embodiments, it will be understood that it will not limit the invention to those embodiments. On the contrary, it is intended to cover all alternatives, modifications and equivalents as may be included in the spirit and scope of the invention as defined by the appended claims.

What is claimed is:

1. A starter drive for starting internal combustion engines having a starter housing, a motor driven shaft with a cylindrical end portion and advancing means between said cylindrical end portion and the motor, said starter drive comprising:

screw sleeve means for cooperatively engaging said advancing means on said motor driven shaft;

ring armature means centrally disposed relative to said screw sleeve means and connected to said screw sleeve means;

a drive pinion coaxially disposed on said cylindrical end portion of said motor driven shaft;

unidirectional clutch means interconnecting said screw sleeve means, said ring armature means and said drive pinion; and means for engaging said ring armature means to said starter housing when said drive pinion is advanced axially along said motor driven shaft by the rotation of said motor when said motor is activated so as to engage a engine ring gear such that said drive pinion is held in mesh with said engine ring gear and the total motor torque is transmitted to said engine ring gear until the motor is deactivated.

2. A starter drive as claimed in claim 1 further comprising:

indexing means for shifting said unidirectional clutch means and said drive pinion into engagement with said engine ring gear when said drive pinion abuts said engine ring gear and an obstructing tooth on said engine ring gear prevents engagement of said drive pinion with said engine ring gear.

3. A starter drive as claimed in claim 1 wherein said engaging means further comprises:

electromagnetic coil means mounted in said starter housing at a predetermined axial distance from said engine ring gear.

4. A starter drive as claimed in claim 3 further comprising means for frictionally connecting said ring armature means to said screw sleeve means to limit the free rotational speed of said motor driven shaft.

5. A starter drive as claimed in claim 1 further comprising an annular friction member mounted between said screw sleeve means and said ring armature means.

6. An engine starter drive for engaging an engine ring gear to start an engine, said starter drive having motor means, a motor housing, a drive shaft extending from said motor means, said drive shaft having one end, a first cylindrical portion adjacent said one end, and a second cylindrical portion extending from the motor to said first portion, said second cylindrical portion having advancing means formed thereon, said starter drive comprising:

a sleeve member mounted on said drive shaft, said sleeve member having one end, another end opposite said one end, and an intermediate cylindrical portion extending from said one end to said another end, said intermediate cylindrical portion having an inner diameter and outer diameter, said inner diameter slidably rotatably mounted on said advancing means on said drive shaft;

a first annular member connected to said outer diameter of said sleeve member;

a pinion gear slidably mounted on said first cylindrical portion of said drive shaft for axial movement relative to said one end of said drive shaft, said pinion gear further being adapted for movement into and out of engagement with said engine ring gear to start said engine;

a unidirectional clutch member coaxially disposed with said drive shaft and interposed said pinion gear and said first annular member, said clutch member further being slidably mounted on said outer diameter of said intermediate cylindrical portion of said sleeve member;

a ring annular armature member coaxially disposed with said second portion of said drive shaft and interposed between said first annular member and said motor means, said ring annular armature member further being connected to said first annular member; and means for interconnecting said motor housing and said ring armature member when said drive pinion is advanced along said cylindrical end portion by the rotation of said motor means when activated so as to contact said engine ring gear such that said drive pinion is held in engagement with said engine ring gear and said total motor torque is transmitted to said engine ring gear until said motor is deactivated.

7. An engine starter drive as claimed in claim 6 wherein said interconnecting means further comprises electromagnetic coil means mounted in said motor housing at a predetermined axial distance from said engine ring gear.

8. An engine starter drive as claimed in claim 6 further comprising antidrift means mounted on said first cylindrical portion of said drive shaft for preventing said pinion drive from contacting said engine ring gear when said motor means is deactivated.

9. An engine starter drive as claimed in claim 6 further comprising means mounted between said annular member and said armature member for providing a frictional connection therebetween so as to absorb the torque generated by said pinion drive when said pinion drive overruns said drive shaft rotation.

10. An engine starter drive as claimed in claim 6 further comprising a resilient member mounted to said unidirectional clutch member, said resilient member further being interposed said unidirectional clutch member and said first annular member.

11. An engine starter drive as claimed in claim 10 further comprising first means, interposed said unidirectional clutch member and said annular member on said sleeve member, for biasing said sleeve member away from said unidirectional clutch member.

12. A starter drive for engaging a ring gear for an internal combustion engine having a starter housing, a motor drive shaft with a cylindrical end portion and a helical threaded portion between said cylindrical end portion and the motor, said starter drive comprising:

a sleeve member mounted on the drive shaft, said sleeve member having one end, another end opposite said one end and an intermediate cylindrical portion extending from said one end to said another end, said intermediate cylindrical portion having an inner diameter and an outer diameter, said inner diameter having helical threads to mutually engage said helical threaded portion on said motor drive shaft, said outer diameter having straight splines formed thereon;

a first annular member mounted on said straight splines on said sleeve member;

a pinion gear slidably mounted on said cylindrical end portion for axial movement on said motor drive shaft relative to said cylindrical end portion, said pinion gear further being adapted for movement into and out of engagement with said ring gear to start said internal combustion engine;

a unidirectional roll clutch member connected to said pinion gear and slidably journalled to said straight splines on said sleeve member, said roll clutch member further providing a unidirectional torque transmitting connection between said sleeve member and said pinion gear;

a casing member mounted on said roll clutch member, said casing member further extending axially from said roll clutch member to spatially enclose said first annular member;

resilient means, disposed within said casing member and mounted to said roll clutch member, for transmitting starter motor torque from said sleeve member, through said first annular member, to said roll clutch member and for absorbing impact loads generated by said mutually engaging threads and the resisting load from the engine;

a washer member centrally mounted on said motor drive shaft, said washer member having one end portion extending radially of said motor drive shaft, an opposite end portion extending radially of said motor drive shaft and a longitudinal section extending from said one end portion to said opposite end portion, said longitudinal section having portions defining a plurality of slots extending through said opposite end portion;

a second annular member centrally mounted on said motor drive shaft, said second annular member having an inner diameter, an outer diameter and portions defining a plurality of arcuate slots interposed said inner and outer diameters and extending through said inner diameter and forming a plurality of tabs disposed adjacent to said slots;

first means, abutting said plurality of tabs on said second annular member and said opposite end portion of said washer member, for biasing said second annular member longitudinally away from said opposite end portion of said washer member;

second means, abutting said unidirectional clutch member and said first annular member, for biasing said unidirectional clutch member longitudinally along said splined connection away from said sleeve member;

abutment means, mounted within said casing, for confining said first annular member and said one end portion of said washer member within said casing; and means for engaging said second annular member to said starter housing when said pinion gear is advanced axially along said motor drive shaft to engage said engine ring gear by the rotation of said motor drive shaft when said motor is activated such that said pinion gear is held in mesh with said engine gear and the total motor torque is transmitted to said internal combustion engine to start said engine until said motor is deactivated.

13. A starter drive as claimed in claim 6 or 12 further comprising indexing means for shifting said pinion gear into engagement with said engine ring gear when said drive pinion abuts said engine ring gear and an obstructing tooth on said engine ring gear prevents the engagement of said pinion gear with said engine ring gear.

14. A starter drive as claimed in claim 13 wherein said engaging means further comprises electromagnetic coil means mounted in said starter housing at a predetermined axial distance from said engine ring gear.

15. A starter drive as claimed in claim 14 further comprising means for providing a frictional connection between said one end portion of said washer member and said first annular member so as to absorb torque transmitted by said engine when said pinion gear overruns said drive shaft and to limit the free rotational speed of said motor drive shaft.

16. An engine starter drive as claimed in claim 15 further comprising antidrift means, mounted on said cylindrical end portion of said drive shaft, for biasing said pinion gear away from said engine ring gear when said motor is deenergized.

17. An engine starter drive as claimed in claim 12 wherein said motor driven shaft has a one end adjacent said cylindrical end portion and further comprising a stop member mounted on said motor drive shaft adjacent said engine ring gear to limit the axial movement of said pinion gear along said motor drive shaft.

18. In combination with an internal combustion engine of the type having an engine ring gear, battery means associated with said internal combustion engine, relay means electrically connected to said battery means, switch means connected to said relay means for providing an electrical connection through said relay means when said switch means is activated, the improvement comprising:

a starter motor having a housing; electric armature means rotatably mounted in said housing; and a drive shaft means extending from said armature means, said electric armature means further being connected to said relay means, so that when said switch means is activated, said relay means provides electrical current to said electric armature means to rotate said drive shaft means;

engine starter drive means rotatably and slidably mounted on said drive shaft means;

means, mounted on said drive shaft means, for axially translating said starter drive means, by inertia, so as to engage said engine ring gear when said armature means rotates as said switch means is activated so as to transmit torque from said electric armature means to said engine ring gear to start said internal combustion engine; and electromagnetic coil means mounted in said housing for holding said starter drive means to said housing when said starter means engages said engine ring gear to start said engine, said coil means further holding said starter means in engagement with said engine ring gear until said switch means is deactivated.

19. In the combination as set forth in claim 18 further comprising transmission lockout switch means connected to said relay means for preventing an electrical connection through said relay means when said switch means is activated until said transmission lockout switch means is in a neutral or park position.

20. A starter drive for starting an internal combustion engine having a ring gear and battery means, said starter driving comprising:

a starter motor connected to said battery means, said starter motor having a housing, electric armature means rotatably mounted in said housing and a drive shaft extending from said armature means, said drive shaft having a cylindrical end portion and threaded screw means between said cylindrical end portion and said electric armature means;

ring armature means centrally disposed relative to said screw sleeve means and connected to said screw sleeve means;

a drive pinion coaxially disposed on said cylindrical end portion of said motor driven shaft;

unidirectional clutch means interconnecting said screw sleeve means, said ring armature means and said drive pinion; and means for engaging said ring armature means to said starter housing when said drive pinion is advanced axially along said motor drive shaft by the rotation of said electric armature means when said motor is activated so as to engage said engine ring gear such that said drive pinion is held in mesh with said engine ring gear and the total motor torque is transmitted to said engine ring gear until said motor is deactivated.

* * * * *

UNITED STATES PATENT AND TRADEMARK OFFICE

CERTIFICATE OF CORRECTION

PATENT NO. : 4,366,385

DATED : December 28, 1982

INVENTOR(S) : James O. Williams

It is certified that error appears in the above-identified patent and that said Letters Patent is hereby corrected as shown below:

Column 6, line 3, before "first" insert ---- the ----.

Column 8, line 44, delete "with" and insert ---- within ----.

In The Claims

Claim 20, column 13, line 7, delete "motor driven" and insert ---- drive ----.

Claim 20, column 14, line 3, delete "motor drive" and insert ---- drive ----.

Signed and Sealed this

*Eighteenth* Day of *September 1984*

[SEAL]

*Attest:*

GERALD J. MOSSINGHOFF

*Attesting Officer*

*Commissioner of Patents and Trademarks*